US009803364B2

(12) United States Patent
Hsieh

(10) Patent No.: US 9,803,364 B2
(45) Date of Patent: Oct. 31, 2017

(54) LIGHT STEEL ROOF TRUSS WITH STRUCTURE OF DOUBLE CONTINUOUS BEAM

(75) Inventor: Ying Chun Hsieh, Fengyuan (CN)

(73) Assignee: YING CHUN HSIEH (CN)

( * ) Notice: Subject to any disclaimer, the term of this patent is extended or adjusted under 35 U.S.C. 154(b) by 0 days.

(21) Appl. No.: 13/391,358

(22) PCT Filed: Feb. 8, 2010

(86) PCT No.: PCT/CN2010/000172

§ 371 (c)(1),
(2), (4) Date: Feb. 20, 2012

(87) PCT Pub. No.: WO2011/020283

PCT Pub. Date: Feb. 24, 2011

(65) Prior Publication Data

US 2012/0192520 A1 Aug. 2, 2012

(30) Foreign Application Priority Data

Aug. 20, 2009 (CN) ..... 2009 2 0171128 U

(51) Int. Cl.

| | |
|---|---|
| ***E04C 3/00*** | (2006.01) |
| ***E04C 3/08*** | (2006.01) |
| ***E04B 1/24*** | (2006.01) |
| ***E04B 7/02*** | (2006.01) |
| ***E04C 3/11*** | (2006.01) |
| ***E04C 3/40*** | (2006.01) |
| ***E04D 12/00*** | (2006.01) |
| *E04C 3/04* | (2006.01) |

(52) U.S. Cl.

CPC ..... *E04C 3/08* (2013.01); *E04B 1/24* (2013.01); *E04B 7/024* (2013.01); *E04C 3/11* (2013.01); *E04C 3/40* (2013.01); *E04D 12/006* (2013.01); *E04B 2001/249* (2013.01); *E04B 2001/2415* (2013.01); *E04B 2001/2448* (2013.01); *E04B 2001/2454* (2013.01); *E04B 2001/2472* (2013.01); *E04B 2001/2496* (2013.01); *E04C 2003/0473* (2013.01); *E04C 2003/0491* (2013.01)

(58) Field of Classification Search

CPC ..... E04B 1/19; E04C 2/38; E04F 13/0821
USPC ..... 52/578, 167.3, 293.3, 653.1, 655.1
See application file for complete search history.

(56) References Cited

U.S. PATENT DOCUMENTS

| | | | | |
|---|---|---|---|---|
| 2,947,390 | A * | 8/1960 | Stollenwerk | 52/656.1 |
| 3,688,461 | A * | 9/1972 | Rensch et al. | 52/653.1 |
| 3,706,169 | A * | 12/1972 | Rensch | 52/263 |
| 4,347,015 | A * | 8/1982 | Olashaw | 403/219 |

(Continued)

FOREIGN PATENT DOCUMENTS

| | | |
|---|---|---|
| CN | 201071565 | 6/2008 |
| CN | 201144463 | 11/2008 |
| WO | WO2009011516 | 1/2009 |

*Primary Examiner* — Basil Katcheves
(74) *Attorney, Agent, or Firm* — Pearne & Gordon LLP

(57) ABSTRACT

A light steel roof truss with a structure of a double continuous beam includes structural beams (1) and structural columns (2). The structural beam (1) consists of a pair of continuous beams, and the structural column (2) is located between the two continuous beams through locating holes (4). Thereby the stability of a support structure of the roof truss is increased, and the supporting members of the roof truss can be connected conveniently.

9 Claims, 6 Drawing Sheets

(56) References Cited

U.S. PATENT DOCUMENTS

| | | | | |
|---|---|---|---|---|
| 4,350,318 | A * | 9/1982 | Gallis | 249/40 |
| 6,088,989 | A | 7/2000 | Matsu et al. | |
| 6,802,169 | B2 * | 10/2004 | Simmons | 52/648.1 |
| 7,310,920 | B2 * | 12/2007 | Hovey, Jr. | 52/655.1 |
| 8,061,108 | B2 * | 11/2011 | Tonyan et al. | 52/745.13 |
| 8,146,322 | B2 * | 4/2012 | Karns | 52/655.1 |
| 2007/0209314 | A1 | 9/2007 | Vaughn | |

* cited by examiner

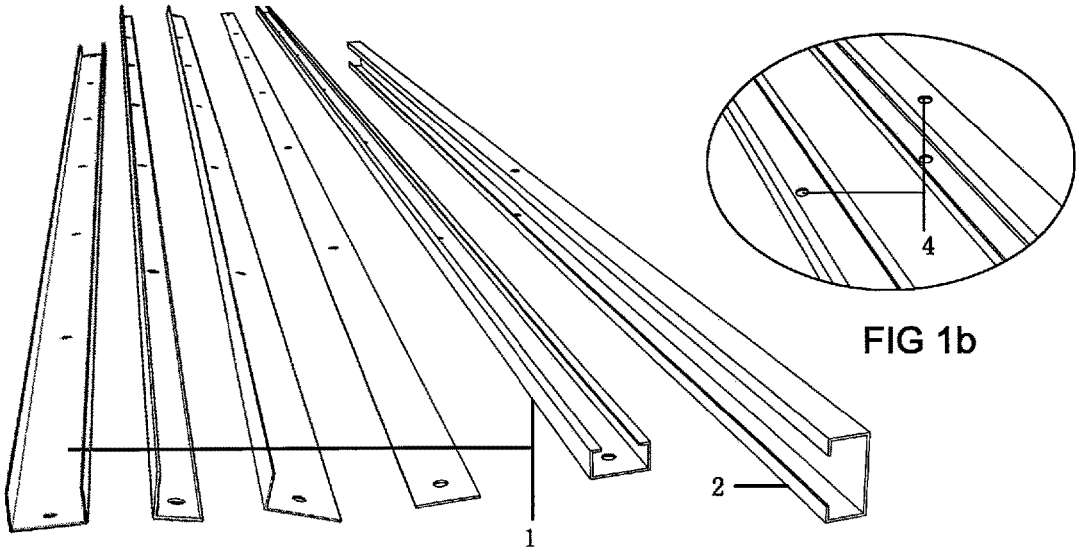
FIG 1b
FIG 1a
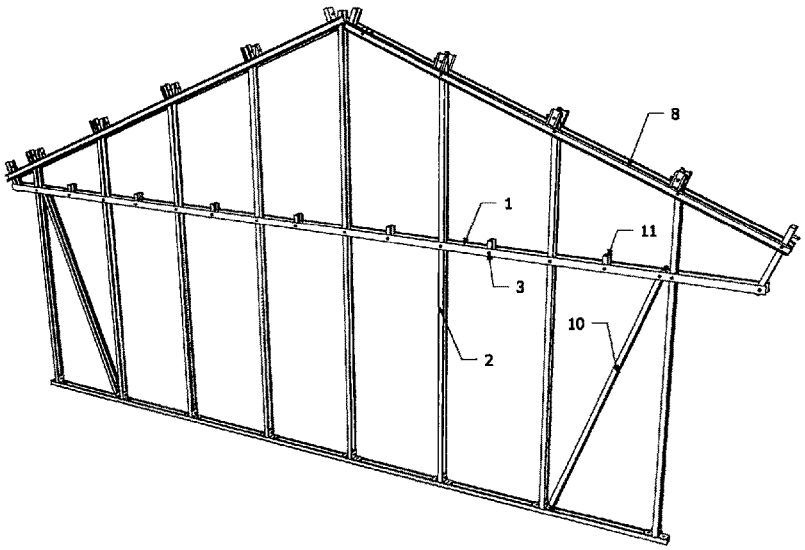
FIG 2a

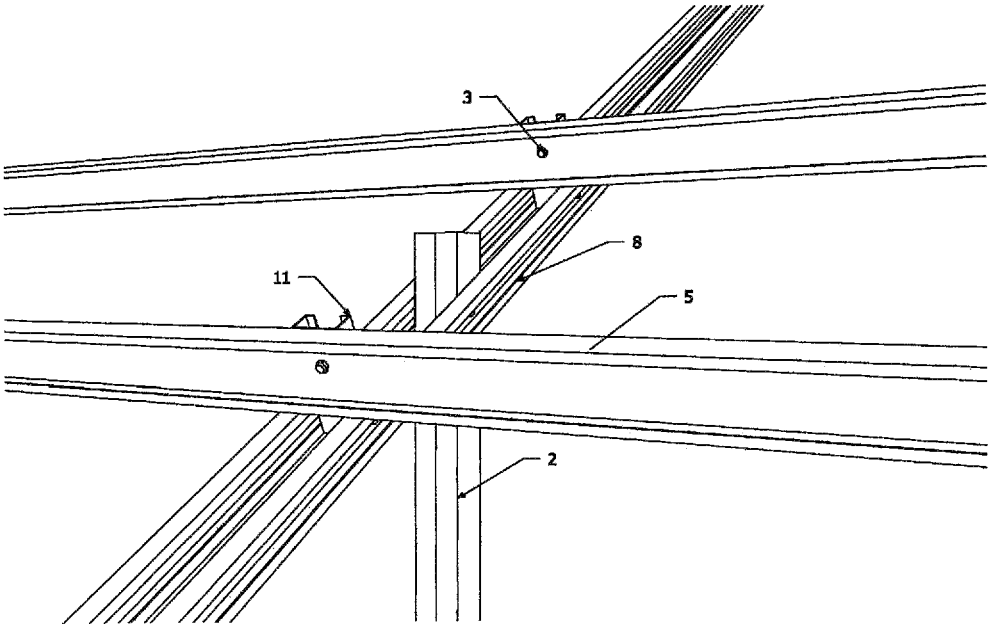
FIG 5b
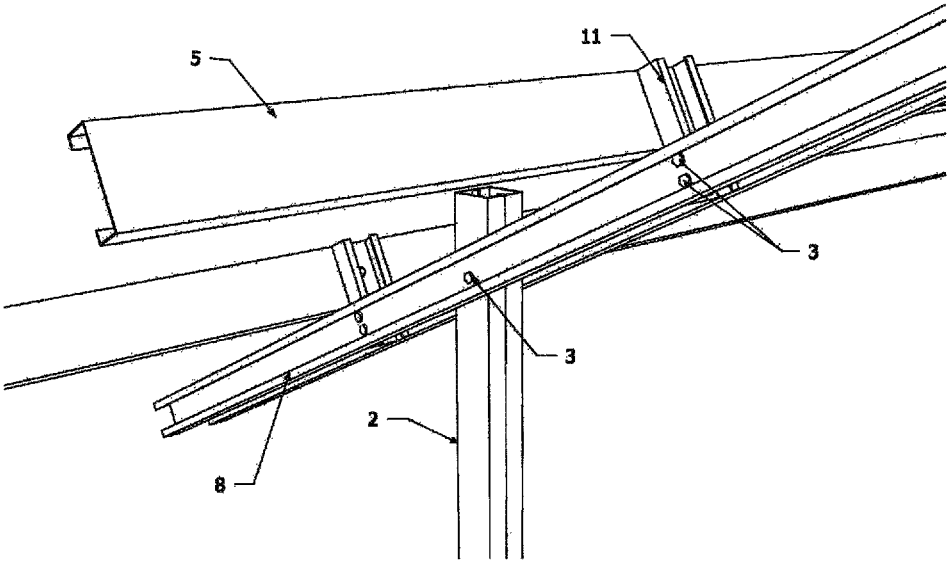

LIGHT STEEL ROOF TRUSS WITH STRUCTURE OF DOUBLE CONTINUOUS BEAM

CROSS REFERENCE TO RELATED APPLICATIONS

This is a national stage filing in accordance with 35 U.S.C. §371 of PCT/CN2010/000172, filed Feb. 8, 2010, which claims the benefit of the priority of Chinese Patent Application No. 200920171128.9, filed Aug. 20, 2009, the contents of each are incorporated herein by reference.

TECHNICAL FIELD

The present invention relates to a product used in lightweight steel structure; specifically, which relates to lightweight steel structure for buildings with a structure of double continuous beam.

BACKGROUND ART

In China lightweight steel structure buildings have been undergo fast development and widely used in industrial buildings. Lightweight steel structure is a new trend for residential buildings. Presently, although the cost is higher than conventional concrete buildings, they are advantageous in their fast construction speed, energy saving and carbon emission reduction. The advantages of lightweight steel structure buildings have been extensively noticed and, they have not only already become the first choice in constructing industrial buildings, but also been extensively used in residential buildings.

The structure design, configuration and assembly method of the lightweight steel for buildings have great affects on the quality and construction work. Usually, the main supporting components of the frame/post structure system, such as the structural beams and the structural columns/studs, are made of cold bending or cold rolling light gauge steel having the thickness of 1.5 mm to 5 mm. The cross section of cold bending steel has a uniform thickness and arc-shaped corner. In the bearing wall structure system the cold-formed light gauge steel also comprises various shapes having thickness under 1.5 mm. In addition, structure components are combined with small size of steel angle, steel tube, steel channel, steel plate and steel cylinder, and cold-formed light gauge steel, are also often used as purlin connectors, truss diagonal bracings, etc.

However, there are still a lot to be improved in the building design, structure design, and erection methods of lightweight steel buildings. Presently, when a lightweight steel frame is erected and assembled on site, the supporting components such as the structural beams, the structural columns/studs, and the purlins, etc., made of cold-formed light gauge steel, steel angle, steel channel or steel plates, are usually connected, positioned and fastened by end-to-end joint (such as rigid or hinge). The connecting work is very complicated and serious accumulated errors are brought out due to the large quantity of joint. Therefore, in practical applications, the existing frames for buildings still have lot of defects.

In view of the above defects existing in the current lightweight steel structure building, the present inventor creates a novel lightweight steel structure with double continuous beam system by using his rich practical experiences and professional knowledge, combing the application of theory and actively performing the research and innovation, and improves the current lightweight steel structure building thereby bringing more practicality. After iterations of research, experimentation and improvement, the present invention of great practical value is finally created.

SUMMARY OF THE INVENTION

It is an objective of the present invention to overcome the defects of the existing lightweight steel structure building and solve the technical problems by providing novel lightweight steel structure having a double continuous beam which is convenient to install on site, more reasonable design and more stable structure so as to more suitable for practical applications.

It is another objective of the present invention to solve the technical problems by providing a novel lightweight steel structure having a double continuous beam which is convenient to connect a various components and eliminate accumulated errors during the installation work so as to more suitable for practical applications.

It is yet another objective of the present invention to solve the technical problems by providing a lightweight steel structure with a double continuous beam, which provides lateral support on weak side of structure members both of beam and column. The high efficient lateral support improves the strength of the structural especially under high density column system, so as to be more suitable for practical applications.

The objective of the present invention and the addressed technical problems can be achieved or solved by the following technical solutions. In accordance with the present invention, a lightweight steel structure with a double continuous beam comprising structural beams and structural columns/studs, characterized in that the said lightweight steel for buildings comprises a double continuous structural beam holding the said structural column, and the structural column is positioned between the double continuous structural beams by fixing components.

The objective of the present invention and the addressed technical problems can be further achieved or solved by the following technical measures.

The above-mentioned lightweight steel structure for buildings, wherein the said structural beams and the said structural columns/studs are made of cold-formed light gauge steel, steel angle, steel channel or steel plate, and holes for positioning and connecting are provided in the web of the said structural beam and both sides of the said structural column.

The above-mentioned lightweight steel structure for buildings, wherein the said cold-formed light gauge steel is a C-shaped cold-formed light gauge steel.

The above-mentioned lightweight steel structure for buildings, wherein the structural beams and the structural columns/studs are positioned and connected by the holes for positioning and connecting provided therein through the fixing components.

The above-mentioned lightweight steel structure for buildings, wherein the structural beam comprises girder, rafter and structural truss beam.

The above-mentioned lightweight steel structure for buildings, wherein a bracing is provided between the structural beams and the structural columns for reinforcing the stability.

The above-mentioned lightweight steel structure for buildings, wherein the said lightweight steel for buildings further comprises purlins and the said purlins are located on the structural beam/rafter through purlin connectors.

The above-mentioned lightweight steel structure for buildings, wherein the said lightweight steel structure further comprises webs between top and bottom members, the webs are positioned and connected by the positioning holes and fixing components.

The above-mentioned lightweight steel structure for buildings, wherein the said lightweight steel for buildings further comprises wall studs, one end of the wall stud is fixed between the double continuous structural beams by stud fixing components.

The above-mentioned lightweight steel structure for buildings, wherein the fixing components or the stud fixing components are selected from bolts, self-tapping screws or rivets.

From the above it can be seen that the present invention relates to a lightweight steel structure with a structure of double continuous beam comprising structural beams and structural columns/studs. The structural beam consists of a pair of continuous beams holding the structural column/stud. The structural column/stud is positioned between the double continuous beams through fixing components The present invention has an advantageous structure thereby the stability of the structure is increased, the connecting work of the members of the lightweight steel structure is simplified, the accumulated errors during the installation are eliminated, and the strength of the structure is reinforced.

In virtue of the above technical solutions, the claimed lightweight steel for buildings with a structure of double continuous beam has at least the following advantages:

(1) The onsite assembling work is simplified.

(2) The problem of accumulated errors during the site connecting is eliminated.

(3) The lightweight steel structure with double continuous beam according to the present invention holds high density columns so that the connection of the structural beams and columns/studs can reinforce the weak side of beam/column members, the structure so as to be more suitable for practical applications.

(4) In addition to residential housings, the lightweight steel structure according to the present invention can be used in large-span buildings such as warehouses, factory buildings, shopping malls, exhibit halls, stadiums, and waiting rooms in a railway/bus station; multi-story buildings such as multi-story factory buildings, schools, hospitals, office buildings, and entertainment buildings; and rehabilitation and expansion of supermarkets, retailing and general stores, etc.

In conclusion, the claimed lightweight steel structure with double continuous beam of special configuration is more adaptable for practicality. The same kind of the product does not disclose or use the similar structural design, and thereby the claimed lightweight steel structure with double continuous beam is novel indeed, and makes a great improvement on the structure and function, achieves the great technical advancement and produces the good and practical effects. The lightweight steel structure with double continuous beam has many increased functions relative to the current lightweight steel structure buildings so as to make it more adapted for the practicality and have the wide commercial utilization value. Therefore, the claimed lightweight steel structure with double continuous beam is a novel, advanced and practical design.

The above description is only a generalization for the technical solutions of the present invention. To understand the technical means more clearly and carry out the invention according to the description, the preferred embodiments of the invention are described hereinafter in conjunction with the drawings.

Here is the specific structure of the invention as described by the embodiments and the drawings.

BRIEF DESCRIPTION OF THE DRAWINGS

FIG. 1*a* is a schematic view of the structural beams and the structural columns/studs of the present invention;

FIG. 1*b* is a schematic view of the holes for positioning and connecting in the structural beams and the structural columns;

FIG. 2*a* is an over-all schematic view of the lightweight steel structure with double continuous beam according to one embodiment of the present invention;

FIGS. 5*a*, 5*b* and 5*c* are partial views of the lightweight steel rafter/purlin with double continuous beam according to another embodiment of the present invention;

Figure 2B:
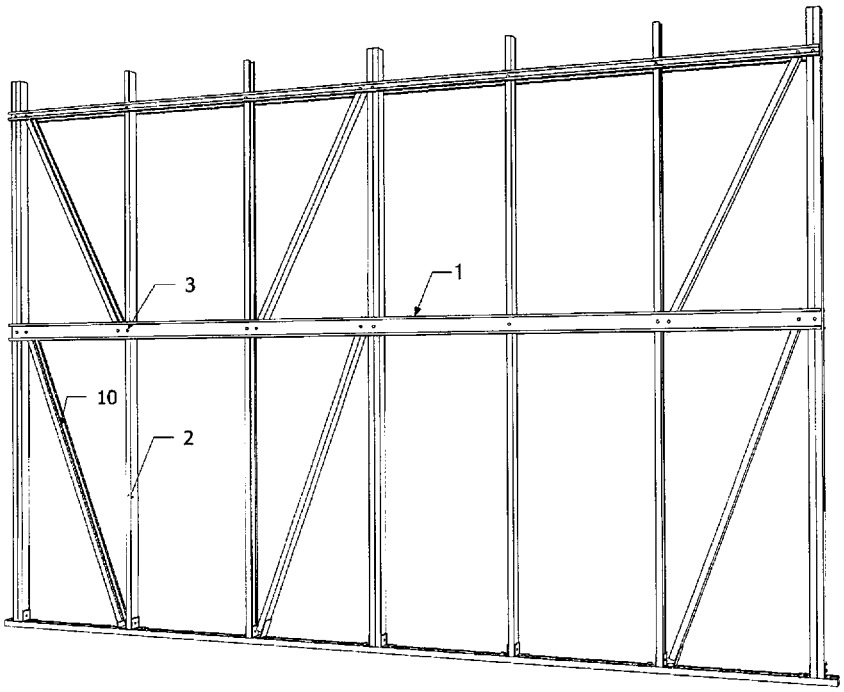
FIG. 2*b* is a schematic view of the double continuous beam according to one embodiment of the present invention.

In the drawings, the numbers represent the members as follows, if no special indication:

1: structural beam; 2: structural column/stud; 3: fixing component; 4: hole for positioning and connecting; 5: purlin; 6: stud fixing component; 7: web; 8: rafter; 9: top/bottom member of truss beam; 10: bracing; 11: purlin connector; 12: wall stud; 13: C-shaped cold light gauge steel; 14: steel plate; 15: steel angle; and 16: steel channel.

BEST MODE OF CARRYING OUT THE INVENTION

In order to further expound the technical means adopted for achieving the objectives of the invention, the mode of carrying out the claimed lightweight steel structure with double continuous beam, characteristics and effects are described in detail hereinafter in combination with the drawings and embodiments.

Referring to FIGS. 1*a*, 1*b*, which are schematic views of the structural beam 1 and the structural column/stud 2 of the present invention, the structural beam and the structural column/stud are made of cold-formed light gauge steel. Holes 4 for positioning and connecting are provided in the web portion of the structural beam 1 and in both sides of the structural beam 2. The structural beam 1 and the structural column/stud 2 of the present invention can be of steel angle 15, steel channel 16, steel plate 14 or C-shaped cold-formed light gauge steel 13 or other materials.

Referring to FIG. 2*a*, which is an over-all schematic view of the lightweight steel structure with double continuous beam of the present invention, in which the structural column/stud 2 is provided between the double continuous structural beam 1, and rafter 8 is supported by and positioned on the structural column/stud 2. The structural column/stud 2 or a purlin 5 is fixed by a fixing component 3 or a purlin connector 11 through the holes 4 for positioning and connecting provided in rafter 8. In addition, in this embodiment, a bracing 10 is provided between the double continuous structural beam 1 and the structural column/stud 2 for reinforcement.

Referring to FIG. 2*b*, which is a schematic view of the double continuous beam according to one embodiment of the present invention; in which structural column/stud 2 is provided between double continuous structural beams 1, and the structural column/stud 2 or the purlin 5 are fixed by the fixing component 3 through the holes for positioning and connecting provided in the double continuous beam or in the purlin. In addition, in this embodiment, bracing 10 is provided between the double continuous structural beam 1 and the structural column 2 for reinforcement.

Figure 3:
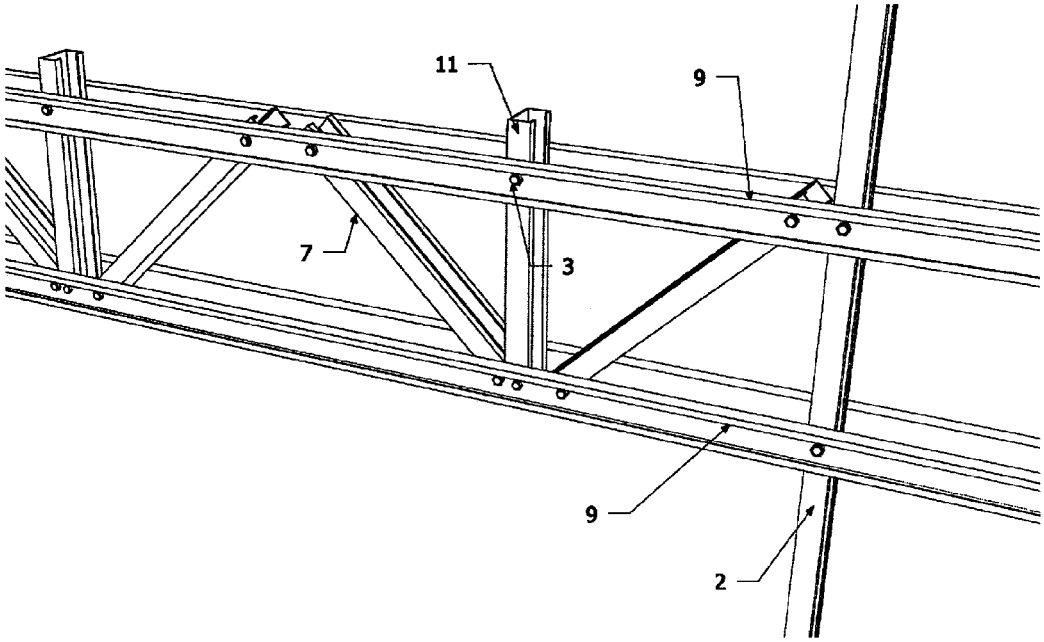
FIG. 3 is a partial view of the lightweight steel structure with double continuous beam according to one embodiment of the present invention.

Referring to FIG. 3, which is a partial view of the lightweight steel structure with double continuous beam according to one embodiment of the present invention; in the illustrated embodiment, the double top/bottom member of truss beam 9 fixes the structural column/stud 2 through the fixing component 3. Truss web 7 is provided between the double top/bottom members of truss 9, and connected by the fixing component 3.

Figure 4:
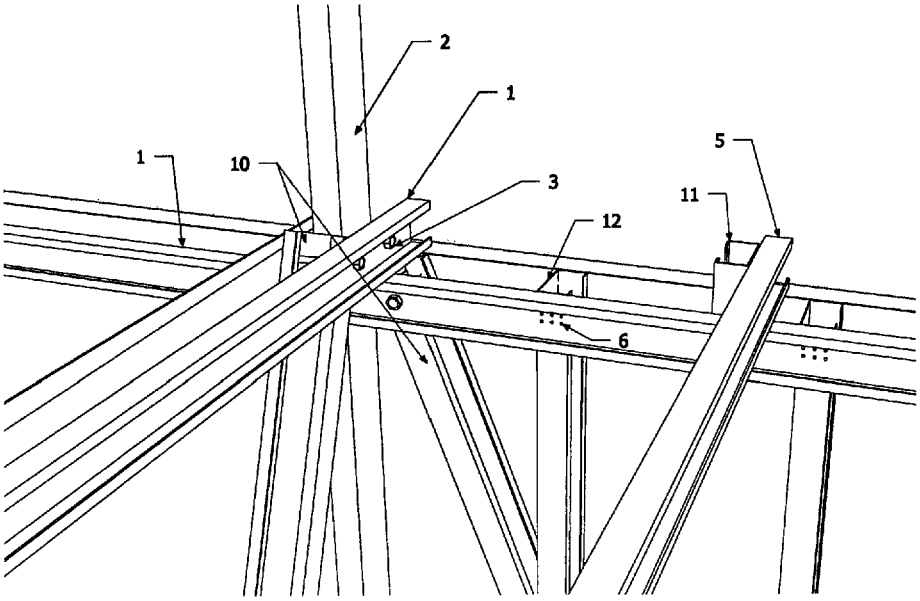
FIG. 4 is a partial view of the lightweight steel structure with double continuous beam according to another embodiment of the present invention.

Referring to FIG. 4, which is a partial view of the lightweight steel structure with double continuous beam according to another embodiment of the present invention; the double continuous structural beam 1 is fixed by the structural column/stud 2 through fixing component 3. The purlin 5 is fixed by purlin connector 11. One end of a wall stud 12 is fixed between the double continuous structural beams 1 through a stud fixing component. From FIG. 4 it can be seen clearly that the open end of the structural beam 1 extends towards the outside when the structural column/stud 2 is fixed by the double continuous structural beams 1.

Figure 5A:
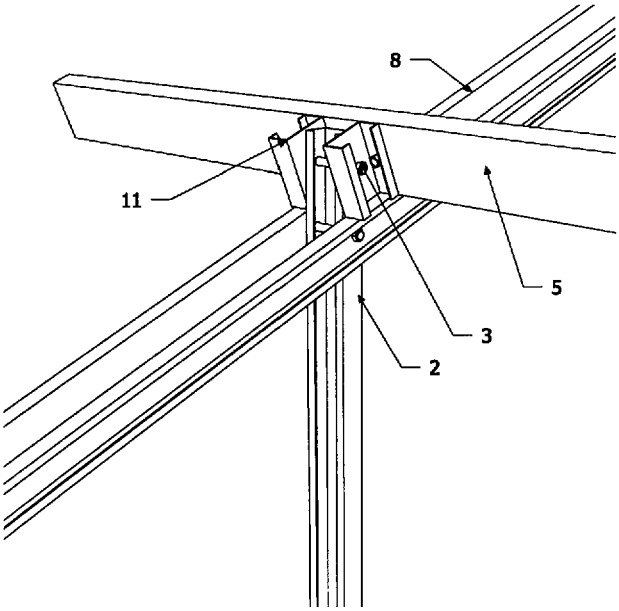

Referring to FIGS. 5*a*, 5*b* and 5*c*, which are partial views of the lightweight steel structure with double continuous beam according to another embodiment of the present invention; the drawings clearly show how the purlin 5 is fixed to the rafter 8. In this embodiment, the rafter 8 is positioned on the structural column/stud 2; the purlin 5 is fixed on rafter 8 by the fixing components 3 and the purlin connector 11. In FIG. 5*c*, a pair of holes for positioning and connecting is provided in the connector 11 which is connected to the rafter 8 through the fixing component 3.

Figure 6:
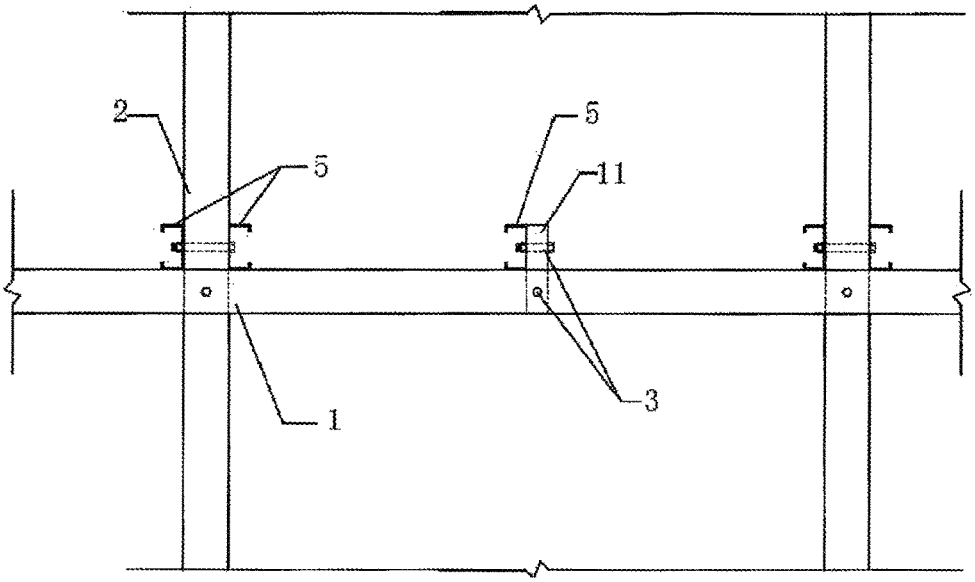
FIG. 6 is an over-all schematic view of the lightweight steel structure with double continuous beam according to one embodiment of the present invention.

Referring to FIG. 6, the lightweight steel structure with double continuous beam according to one embodiment of the present invention mainly comprises double continuous structural beam 1 and structural columns 2. The double continuous structural beam 1 holds the structural column 2. The structural column 2 is positioned between the double continuous structural beams 1 by a fixing component 3. The double continuous structural beams 1 can be made of C-shaped cold-formed light gauge steel 13, steel plate 14, steel angle 15 or steel channel 16.

The claimed lightweight steel structure with double continuous beam formed by the above processes brings the technological innovation, and has many redeeming features for a person skilled in the art. Thereby, the lightweight steel structure with double continuous beam represents technical progress.

The above description is only a preferred embodiment of the invention, rather than a limit to any forms of the invention. Although the particular embodiment of the present invention has been described above, it will be apparent to those skilled in the art that various changes and modifications can be made without departing from the spirit of the present invention. Any changes and modifications to the above embodiment according to the technical essence of the present invention and without departing from the spirit of the present invention shall be embraced within the technical solution of the present invention.

The invention claimed is:

1. A lightweight steel structure comprising at least one pair of continuous structural beams holding a plurality of structural columns/studs therebetween, the structural columns/studs being positioned between the pair of continuous structural beams by fixing components, wherein the at least one pair of continuous structural beams are continuous at a node where at least one of the columns/studs is held between said continuous structural beams, and wherein the structural columns/studs are directly connected to the at least one pair of continuous structural beams.

2. The lightweight steel structure according to claim 1, wherein said structural beams and said structural columns/studs are made of cold-formed light gauge steel, steel angle, steel channel or steel plate, and holes for positioning and connecting are provided in a web portion of said structural beams and both sides of said structural column/stud.

3. The lightweight steel structure according to claim 2, wherein said cold-formed light gauge steel is a C-shaped cold-formed light gauge steel.

4. The lightweight steel structure according to claim 2, wherein the structural beams and the structural columns/studs are positioned and connected by the holes for positioning and connecting provided therein through the fixing components.

5. The lightweight steel structure according to claim 4, wherein said lightweight steel structure further comprises webs between top and bottom members, the webs positioned and connected by the positioning holes and fixing components.

6. The lightweight steel structure according to claim 5, further comprising a wall stud, wherein one end of the wall stud is fixed between the continuous structural beams by fixing components.

7. The lightweight steel structure according to claim 1, further comprising girder, rafter and structural truss beams.

8. The lightweight steel structure according to claim 1, wherein said lightweight steel structure further comprises purlins and said purlins are located on the structural beams through purlin connectors.

9. The lightweight steel structure according to claim 1, wherein the fixing components are selected from bolts, self-tapping screws, or rivets.

* * * * *